US006333477B1

(12) United States Patent
Koyama et al.

(10) Patent No.: US 6,333,477 B1
(45) Date of Patent: Dec. 25, 2001

(54) SWITCH HAVING IMPROVED CONTACT PERFORMANCE

(75) Inventors: Hiromichi Koyama; Koji Sako, both of Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/504,729

(22) Filed: Feb. 16, 2000

(30) Foreign Application Priority Data

Feb. 16, 1999 (JP) ..... 11-36677

(51) Int. Cl.[7] ..... H01H 13/52; H01H 1/06; H01H 13/48

(52) U.S. Cl. ..... 200/513; 200/275; 200/406; 200/512

(58) Field of Search ..... 200/518, 512–517, 200/406–409, 275

(56) References Cited

U.S. PATENT DOCUMENTS 3,886,012 * 5/1975 Slater ..... 200/5 A X
3,941,964 * 3/1976 Yoder ..... 200/5 A X
3,967,084 * 6/1976 Pounds ..... 200/5 A X
4,074,088 * 2/1978 Keough et al. ..... 200/5 A
4,400,596 * 8/1983 Fukukura et al. ..... 200/5 A
4,476,355 * 10/1984 Mital ..... 200/5 A
4,771,139 9/1988 DeSmet ..... 200/5 A
5,313,027 * 5/1994 Inoue et al. ..... 200/5 A
5,595,288 * 1/1997 Matsui et al. ..... 200/513
5,924,555 7/1999 Sadamori et al. ..... 200/512

* cited by examiner

*Primary Examiner*—J. R. Scott
(74) *Attorney, Agent, or Firm*—McDermott, Will & Emery

(57) ABSTRACT

A switch that provides a stable contact and a superior feeling of operation despite the small profile. Its movable contact point 15 comprises a round dome section 15A, a flat section 15C formed by cutting a side alley 17B for a certain specific length and a connection section 15B provided at the outer circumference of the round dome section 15A for connecting the two items 15A and 15C together. On an insulating substrate 11, a first fixed contact point 12 is provided in an area underneath the round dome section 15A, while a second fixed contact point 13 is provided under the flat section 15C always keeping contact therewith.

10 Claims, 10 Drawing Sheets

SWITCH HAVING IMPROVED CONTACT PERFORMANCE

FIELD OF THE INVENTION

The present invention relates to a compact and thin-profile switch for use in various kinds of thin-thickness operation panels of electronic apparatus and other such application fields.

BACKGROUND OF THE INVENTION

There are two major categories in the structure of conventional switches used in operation panels.

The structure shown in FIG. 12, a cross sectional view, and FIG. 13, an exploded perspective view, belongs to category one. On an insulating substrate 1 of the switch, a pattern of fixed contact points 2 is formed, which consists of an outer contact point 2A of ring shape and an inner contact point 2B disposed in the center of the ring shape. The inner contact point 2B is provided with a lead portion 2C, which runs through a cut 2D formed in the outer contact point 2A. An insulation layer 3 is provided on the lead portion 2C and the cut 2D, and a movable contact point 4 of round dome shape made of an elastic thin metal sheet is placed on the outer contact point 2A. A flexible insulating film 5 having an adhesive agent 5A on the bottom surface is provided over the above described structure, and the movable contact point 4 and the insulating substrate 1 are fixed together thereby.

The structure of a category two switch is shown in FIG. 14, a cross sectional view, and FIG. 15, an exploded perspective view. The switch comprises an insulating substrate 6, on which a pattern of fixed contact points 7 is formed. The pattern consists of an outer contact point 7A of ring shape and an inner contact point 7B disposed in the center of the ring shape. The inner contact point 7B is provided with a through hole 7C. The inner contact point 7B is connected to the reverse surface of the insulating substrate 6 via the through hole 7C provided at the center. A movable contact point 4 of round dome shape made of an elastic thin metal plate is placed on the outer contact point 7A. A flexible insulating film 5 having an adhesive agent 5A on the bottom surface is provided over the above described structure, and the movable contact point 4 and insulating substrate 6 are fixed together thereby.

In the switches of either category, a press given to the movable contact point 4 of round dome shape at the center causes an elastic inversion with the movable contact point 4, which brings the bottom center into making contact with the inner contact point 2B (or 7B). The outer contact point 2A and the inner contact point 2B (or the outer contact point 7A and the inner contact point 7B) are thus short-circuited to generate an ON state in the switch.

Recently, along with the general trend of down-sizing among the electronic apparatus, it has been requested for the operation panels as well as the switches incorporated therein to have smaller dimensions. In order to down-size the switches of above described conventional structure, basically the dimensions have to be reduced with respect to each of the constituent parts and components. However, the range of dimensional dispersion that arises during processing of the constituent parts and components remains unchanged. Therefore, the size of inner contact point 2B, or 7B, on which the movable contact point 4 of round dome shape comes to make contact as a result of the elastic inversion, can not be reduced for a substantial extent; among those elements of fixed contact point 2, or 7, pattern-formed on the insulating substrate 1, or 6. This makes it difficult to form the outer contact point 2A, or 7A, around the inner contact point preserving a certain specific insulation gap in dimensions that can insure a stable contact. This is a limitation posed to the down-sizing effort.

Furthermore, the second category switches are costly because they need connection by wiring in the bottom surface of insulating substrate 6. In addition, a subtle difference may arise with the category two switches in the quantity of switching stroke and the feeling of operation, depending on whether the center bottom of the inverted movable contact point 4 makes contact with the small-diameter fixed contact point 7 at a point precisely coincidental to the through hole 7C, or not.

The present invention aims to offer a switch that provides a stable contact performance and a superior feeling of operation even in a down-sized configuration.

SUMMARY OF THE INVENTION

A switch in accordance with the present invention comprises an insulating substrate; a movable contact point disposed above the insulating substrate, which movable contact point being formed of a round dome section, a flat section disposed at a place outside the circumference of the round dome section and a connection section connecting the round dome section with the flat section; a first fixed contact point having a diameter smaller than that of the round dome section, disposed on the insulating substrate at a place underneath the round dome section; and a second fixed contact point disposed on the insulating substrate always keeping contact with the flat section.

In a switch of the above described structure, since the second fixed contact point, which always keeps contact with the movable contact point, can be disposed at a place off the round dome section of movable contact point, both the second fixed contact point and the first fixed contact point locating underneath the round dome section can be formed with the dimensions large enough to assure a stable contact. Thus the switch of the present invention offers both the stable contact performance and the superior feeling of operation.

It is preferred in a switch of the present invention that the flat section of movable contact point is provided with a protrusion that makes contact with the second fixed contact point disposed on insulating substrate. The protrusion makes sure of the contact between the flat section and the second fixed contact point.

A plurality of the movable contact points may be formed with a configuration where pluralities of the round dome sections share a flat section in common. By so doing, the number of constituent parts count may be reduced and the assembly operation will become easier. A switch block of matrix arrangement can be easily fabricated using a plurality of the movable contact points in which pluralities of the round dome sections are contained connected.

An insulation layer may be provided around, at least in part of, the first fixed contact point within a region that comes underneath the round dome section. By so doing, stroke quantity of the round dome section caused as a result of the elastic inversion can be increased for the thickness identical to that of the insulation layer, and a more stable operation and a better feeling of operation may be produced.

A flexible insulation film having an adhesive agent on the bottom surface may be further provided, that sticks on the insulating substrate covering the round dome section and the flat section. In this way, a switch of thin-profile and improved dust-free performance is implemented.

It is preferred that both the insulating substrate and the flat section are provided with a perforation for alignment to be used when combining the two items. A pin penetrating through the perforations in the two items insures a precise aligning accuracy with respect to the two items, and contributes to improving the efficiency of switch assembly.

The movable contact points may be provided easier by forming the round dome sections and the flat sections in an elastic thin metal sheet of belt shape, and then cutting the side alley that has been left in the side part of the elastic thin metal sheet as a result of formation of the above described sections therein. This contributes to offering a switch at a lower cost. More specifically, an operation switch panel having a plurality of individual switches disposed in matrix arrangement can be provided within smaller dimensions at a lower cost, by forming a plurality of round dome sections continually on an elastic thin metal sheet of belt shape and then cutting the side alley at a certain specific length so that a flat section accompanies a certain specific number of round dome sections.

DESCRIPTION OF THE PREFERRED EMBODIMENTS (Embodiment 1)

Figure 1:
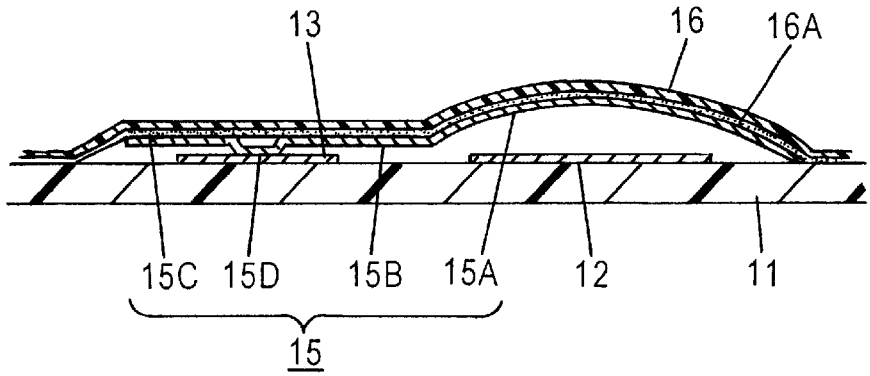
FIG. 1 is a cross sectional front view of a switch in a first exemplary embodiment of the present invention.
Figure 2:
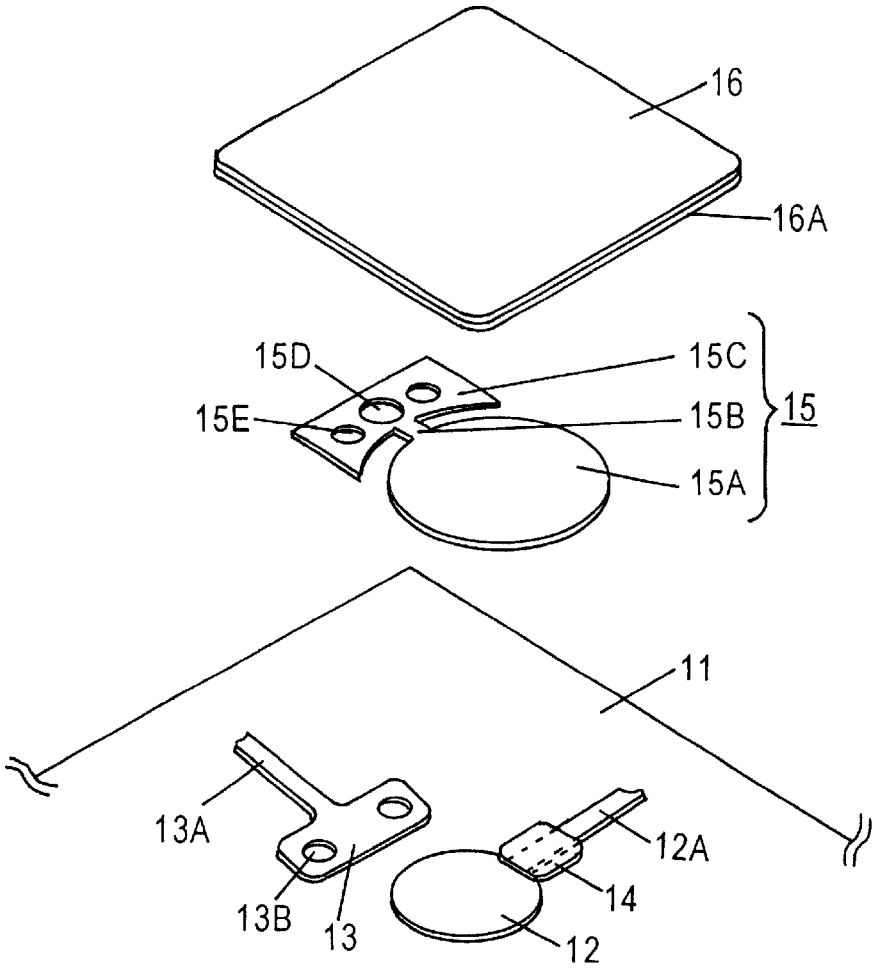
FIG. 2 is an exploded perspective view of the switch of FIG. 1.

A switch in accordance with a first exemplary embodiment of the present invention is described in the following with reference to FIG. 1 through FIG. 4. As shown in FIG. 1 and FIG. 2, a pattern of first fixed contact point 12 of round shape and second fixed contact point 13 of a rectangular shape, which is disposed at a place off the fixed contact point 12 by a certain distance, is formed on the upper surface of an insulating substrate 11. The first and the second fixed contact points 12, 13 are provided respectively with lead sections 12A, 13A. The lead section 12A is provided with an insulation layer 14 placed thereon at the connecting part. The second fixed contact point is provided with a round perforation 13B at the places adjacent to both ends.

A movable contact point 15 is made of an elastic thin metal sheet and consists of a round dome section 15A, a narrow connection section 15B provided at a place of the outer circumference and a flat section 15C of a rectangular shape which is connected via the connection section 15B. The movable contact point 15 is disposed on the insulating substrate 11 so that the center of dome section 15A locates above and coincidental to the center of the first fixed contact point 12, and a protrusion 15D formed on the bottom surface of the flat section 15C at the center making contact with the second fixed contact point 13. A flexible insulation film 16 having an adhesive agent 16A on the bottom surface covers the movable contact point 15 sticking it onto the insulating substrate 11.

The flat section 15C is provided at the places adjacent to both ends with two round perforations 15E having the same dimensions and the same pitch as those of the two round perforations 13B in the second fixed contact point 13. When mounting the movable contact point 15 on the insulating substrate 11, a pin for alignment (not shown) provided in coupling jig is inserted to penetrate through the corresponding pair of two round perforations 13B and 15E. Thus the two items are easily positioned together with a high accuracy and the efficiency of assembly operation is improved.

The first fixed contact point 12 has a diameter smaller by a certain specific value than that of the round dome section 15A. The insulation layer 14 is large enough to cover the lead section 12A so as the bottom circumference edge of dome section 15A does not make contact with the lead section 12A.

Now in the following, a method for forming the movable contact points 15 is described referring to FIG. 3.

Figure 3A:
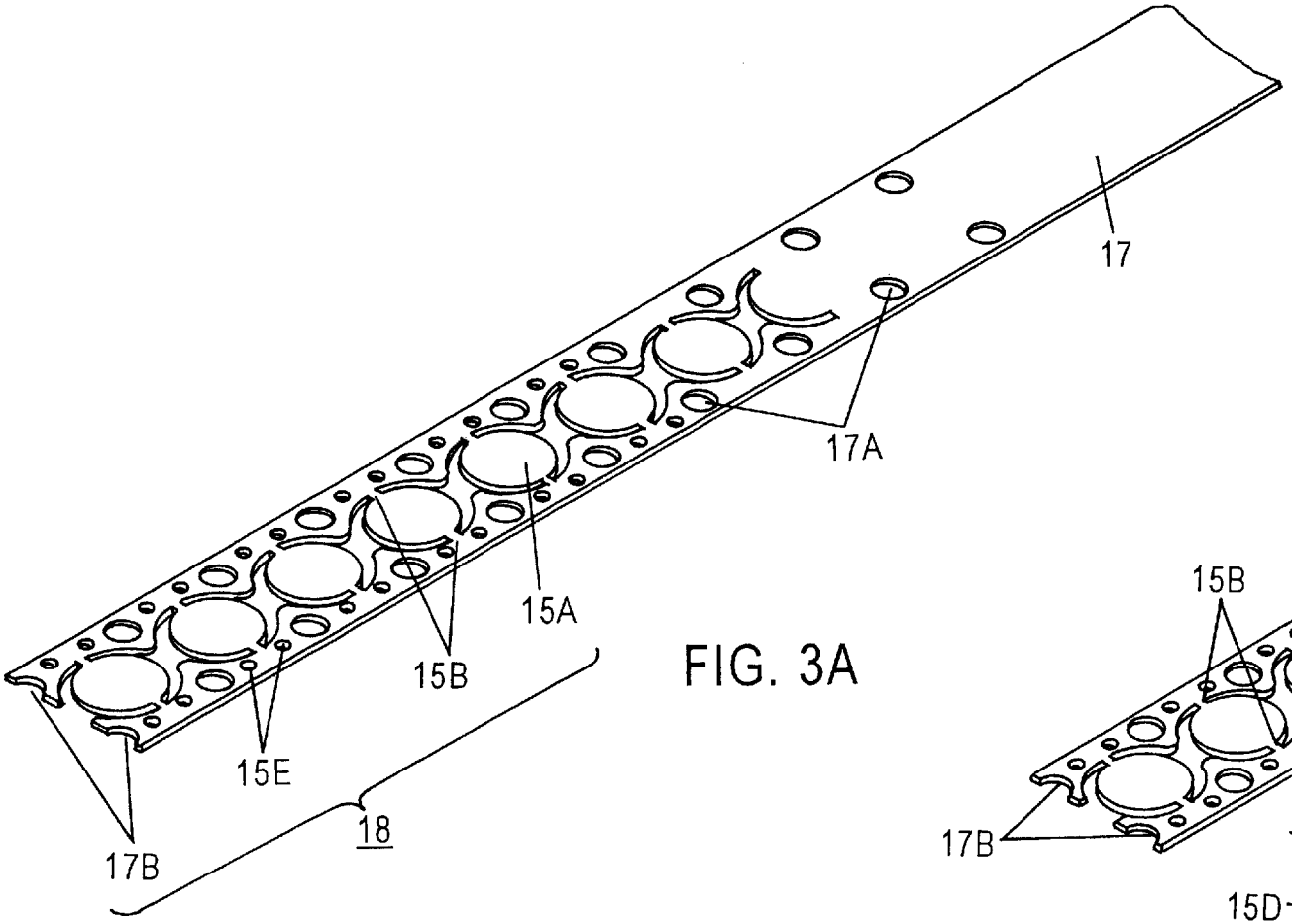
FIG. 3A and FIG. 3B are perspective views showing appearance of the movable contact points for the switch of FIG. 1, used to describe the manufacturing process.

As shown in FIG. 3A, a transfer guide perforation 17A is provided in an elastic thin metal sheet 17 of belt shape at a certain predetermined pitch using a transfer die (not shown). Taking advantage of the transfer guide perforation 17A, the thin metal sheet 17 is transferred and undergoes the continual punching and press-forming processes; and a belt 18 of round dome sections is produced, in which a certain number of round dome sections 15A are connected to the side alley 17B via a pair of connection sections 15B disposed at the opposing places. During the above processing with a transfer die, a pair of round perforations 15E for alignment are also provided in the side alley 17B at the places adjacent to the foot portion of each connection section 15B.

Figure 3B:
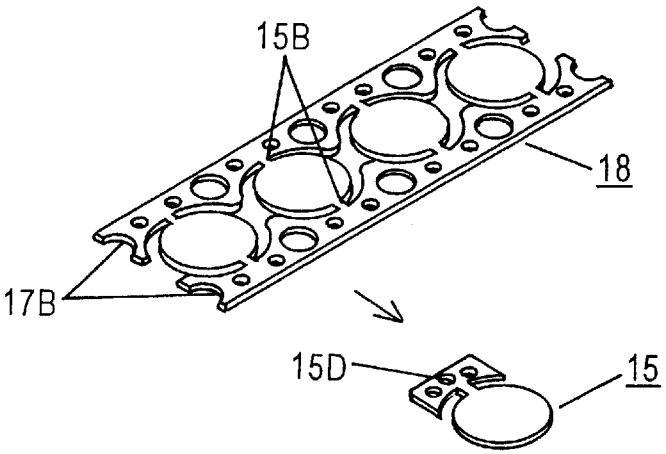

As shown in FIG. 3B, the side alley 17B and a connection section 15B are cut for separation to complete an individual movable contact point 15. During the cutting, a downward protrusion 15D is formed at the middle of each flat section 15C of the individual movable contact point 15.

Next, the operation of a switch in embodiment 1 is described.

Figure 4:
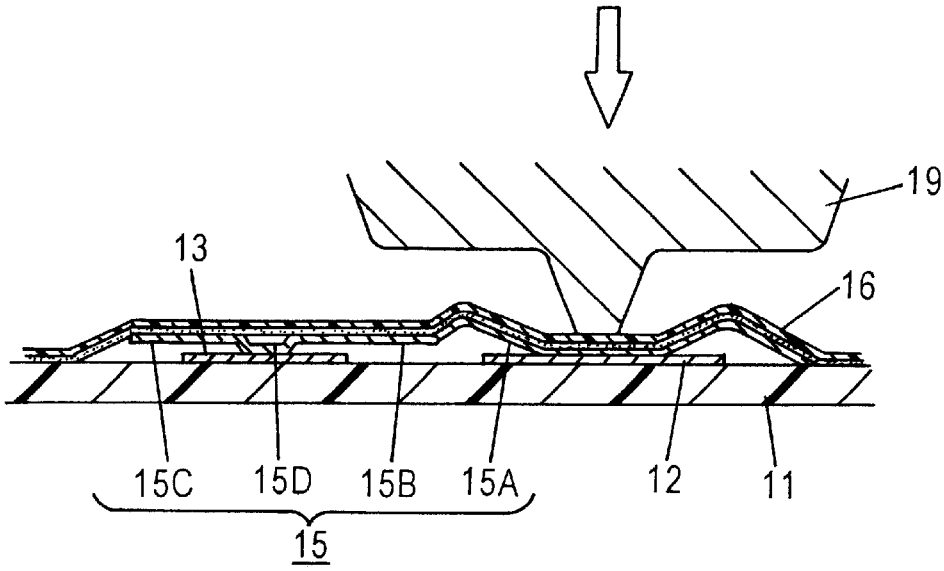
FIG. 4 is a cross sectional front view of the switch of FIG. 1, used to describe a state of operation.

The initial OFF state is shown in FIG. 1. By a press of operation button 19 in an electronic apparatus, the round dome section 15A, together with the insulation film 16, makes an elastic inversion and the center of the bottom surface gets in touch with the first fixed contact point 12, as shown in FIG. 4. Thus the first fixed contact point 12 and the second fixed contact point 13 are short-circuited, bringing the switch into ON state. The signal is transmitted to the apparatus via the lead sections 12A, 13A. As soon as the operation button 19 is released from the pressing force, the round dome section 15A rebounds by the self restorative force. The switch returns to the initial state as shown in FIG. 1, or the OFF state.

In order to prevent the contact between protrusion 15D of flat section 15C and second fixed contact point 13 from going into unstable condition by the influence of elastic inverting action of round dome section 15A, width of the connection section 15B has been determined to be approximately 5 times that the thickness.

Among the fixed contact points pattern-formed on the insulating substrate 11 of a switch in the first exemplary embodiment, the second fixed contact point 13, which always keeps contact with the movable contact point 15, is disposed at a place off the round dome section 15A of movable contact point 15. Therefore, both of the second fixed contact point 13 and the first fixed contact point 12 placed underneath the round dome section 15A can be formed with dimensions large enough to assure a stable contact. The present switch is thus provided with a stable contact performance, a superior feeling of operation and an excellent anti-dust property, in a thin profile. The switch may be ideal for use in an operation panel, or the like application field.

(Embodiment 2)

Figure 5:
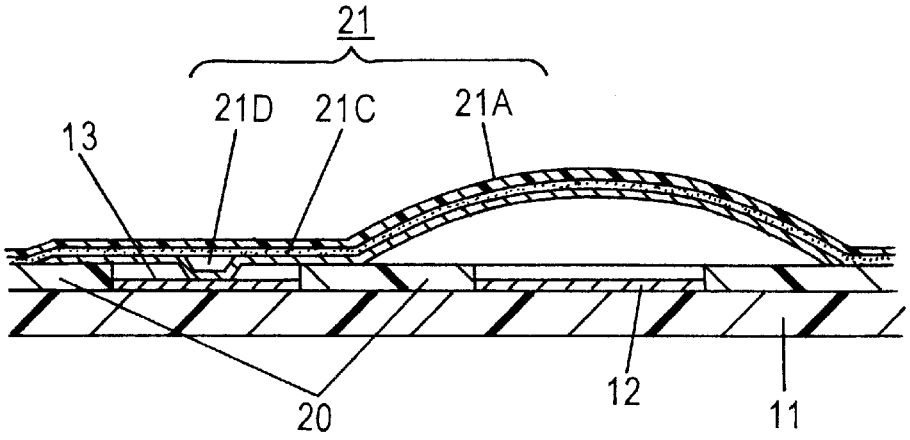
FIG. 5 is a cross sectional front view of a switch in a second exemplary embodiment of the present invention.
Figure 6:
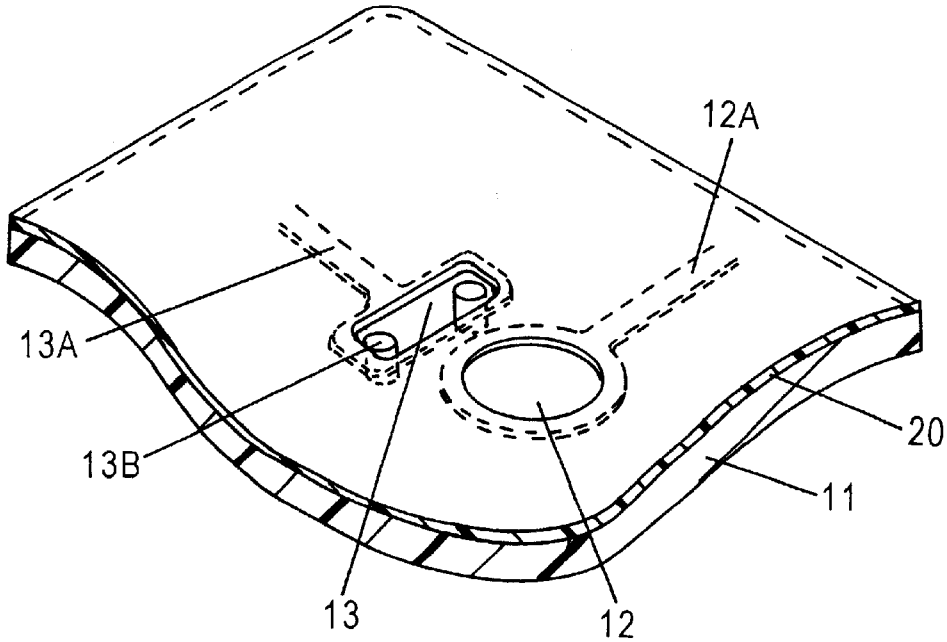
FIG. 6 is a perspective view of an insulating substrate for the switch of FIG. 5, as seen from the above.

A switch in accordance with a second exemplary embodiment of the present invention as illustrated in FIG. 5 and FIG. 6 is different from the switch of embodiment 1 in that the former switch is provided with an insulation layer 20 surrounding the first fixed contact point 12 and the second fixed contact point 13 pattern-formed on the insulating substrate 11. Namely, the insulation layer 14 in embodiment 1 (ref. FIG. 2) has been expanded to cover the entire insulating substrate 11 with the exception of the first fixed contact point 12 and the second fixed contact point 13. The height of protrusion 21D provided on the center bottom surface of the flat section 21C of movable contact point 21 is higher than that of the protrusion 15D in embodiment 1 for a quantity identical to the thickness of the insulation layer 20. Other structures remain the same as those of embodiment 1.

In the present configuration, it is possible for the round dome section 21A to increase its stroke of elastic inversion for a quantity identical to the thickness of the insulation layer 20. Therefore, despite the small dimensions, the round dome section 21A offers a stable operation and a superior feeling of operation.

In a case where there is a limitation for the expansion of the area of insulation layer 20 due to, for example, wiring being disposed on the insulating substrate 11, the insulation layer 20 may be provided to surround at least the first fixed contact point 12, for generating the same effects.

(Embodiment 3)

A switch in accordance with a third exemplary embodiment of the present invention is described with reference to FIG. 7 through FIG. 11.

Figure 7:
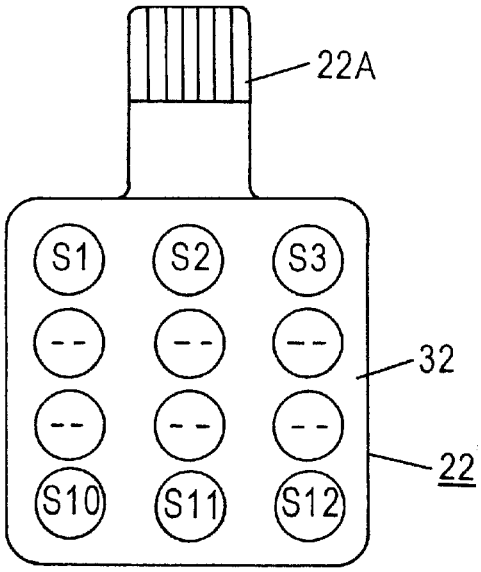
FIG. 7 is a plan view of switches arranged in a matrix form in a third exemplary embodiment of the present invention.

As shown in FIG. 7, a switch in the present exemplary embodiment is formed of twelve individual switches S1 through S12 disposed on a square insulating substrate 22 in a matrix of 3laterals by 4 longitudinals, and a lead out section 22A is provided at one side of the insulating substrate 22 for leading the signal from each of the individual switches S1 through S12 to outside.

Figure 9:
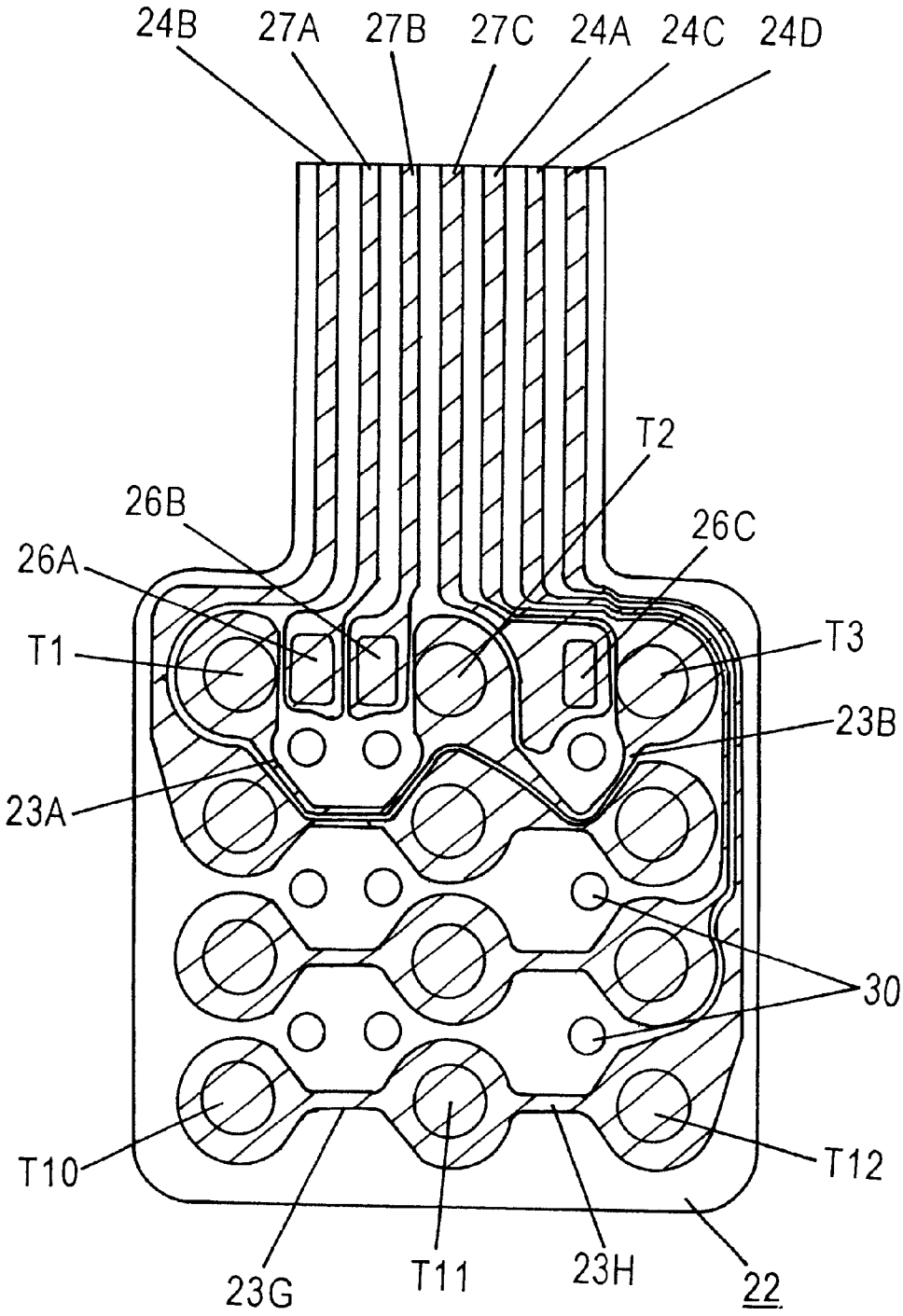
FIG. 9 shows an insulating substrate for the switches of FIG. 7.

The insulating substrate 22 is provided with a conductive pattern as show in FIG. 9 indicated with slanting lines. The conductive pattern consists of first fixed contact points T1–T12 of individual switches S1–S12, eight conduction sections 23A–23H each connecting three of the first fixed contact points, among the twelve first fixed contact points T1–T12, disposed on a lateral line together, four first lead sections 24A–24D for connecting the respective four groups of laterally-connected first fixed contact points to the lead out section 22A, three common fixed contact regions 26A–26C for three serial bodies 25 of movable contact points, and three second lead sections 27A–27C for connecting the respective common fixed contact regions to the lead out section 22A.

Figure 8:
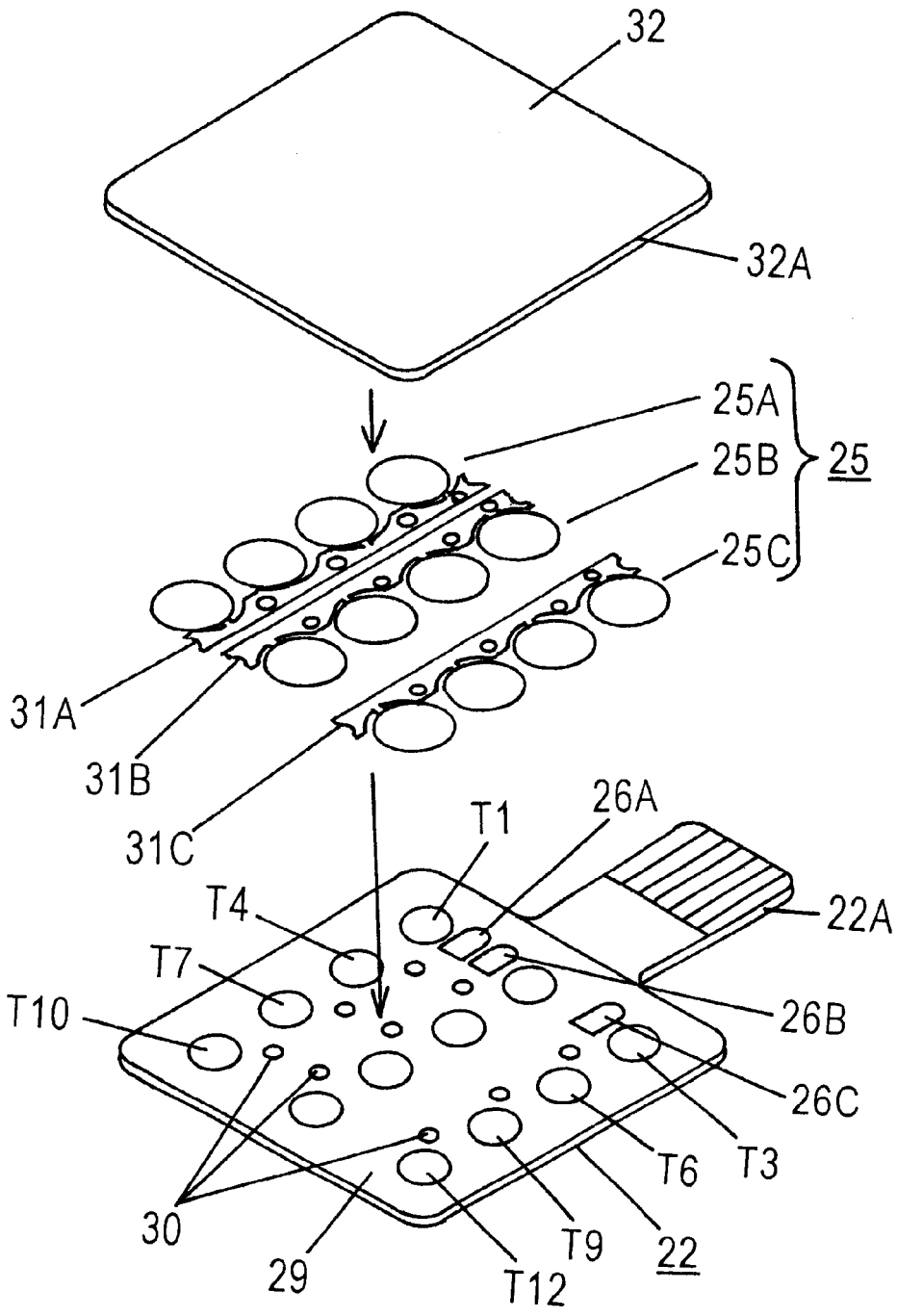
FIG. 8 is an exploded perspective view of the switches of FIG. 7.

An insulation layer 29 (ref. FIG. 8) is provided over the conductive pattern in a manner that the twelve first fixed contact points T1–T12 and the three common fixed contact regions 26A–26C are exposed, and that the tip ends of the first lead sections 24A–24D and the second lead sections 27A–27C formed in the lead out section 22A are exposed.

Nine round perforations 30 provided in spaces between the eight connection sections 23A–23H are for the purpose of aligning the three serial bodies 25A–25C of movable contact points in their respective right positions.

Figure 10:
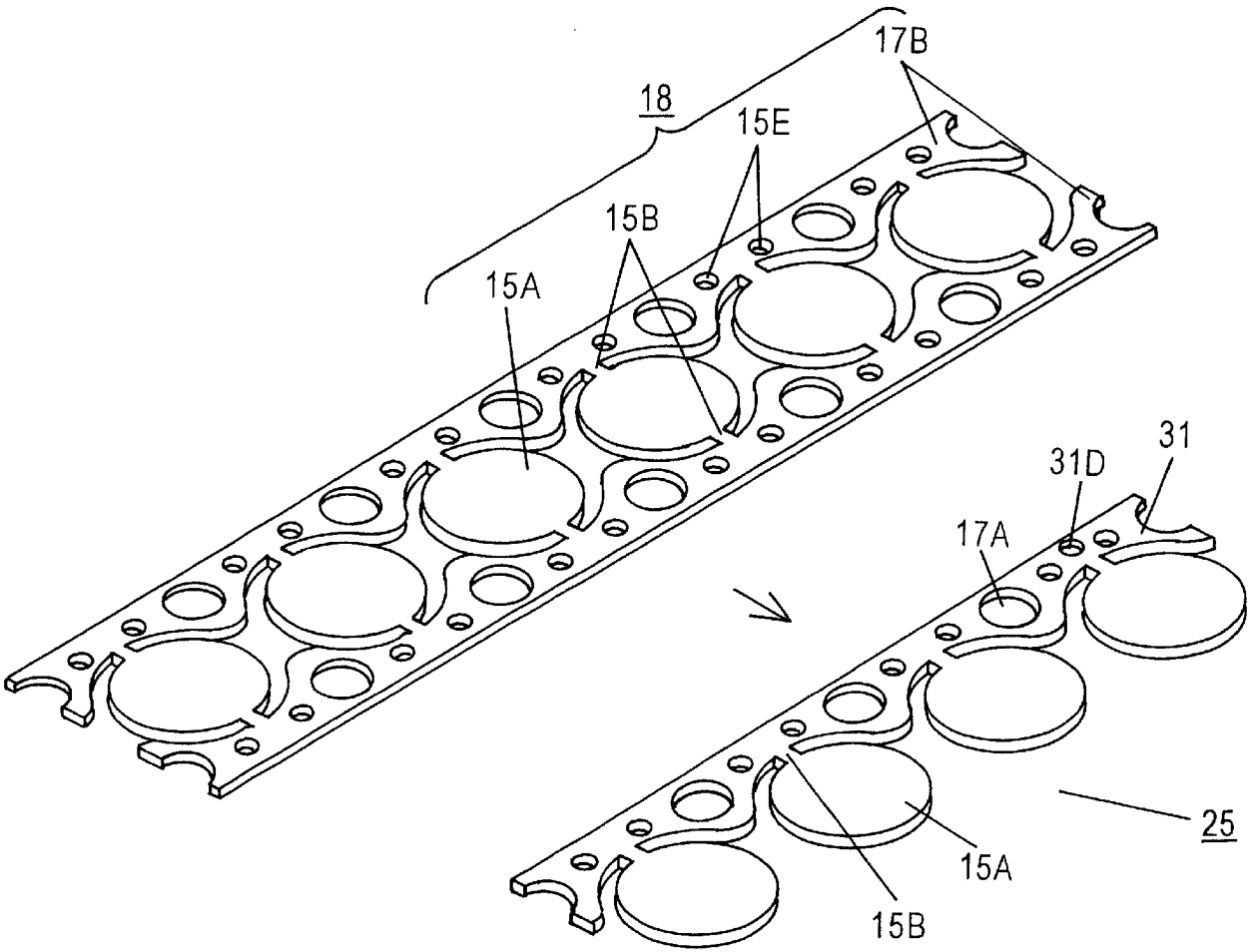
FIG. 10 is a perspective view showing the appearance of movable contact points for the switches of FIG. 7, used to describe the manufacturing process.

Each of the serial bodies 25A–25C of movable contact points is prepared by cutting the elastic thin metal sheet 17 in belt shape shown in FIG. 3A in the side alley 17B and the connection section 15B at certain specific locations, into the form of a belt 18 of round dome sections so that it contains four of the round dome sections 15A, ref. FIG. 10. Thus the serial body 25 of movable contact points containing four dome sections 15A, each of which is connected to a connecting band 31 via the narrow-width connection section 15B, is prepared. A protrusion 31D protruding downward is also provided during the cutting process at the edge of the connecting band 31.

The connection band 31 has already been provided with the transfer guide perforation 17A, as described in embodiment 1. By coupling the perforation 17A with the round perforation 30 of insulating substrate 22, three serial bodies 25A–25C of movable contact points are placed at respective right locations on the insulating substrate 22, and the protrusion 31D gets in touch with respective common fixed contact regions 26A–26C. The three serial bodies 25A–25C of movable contact points are thus mounted on the insulating substrate 22.

A flexible insulation film 32 of approximately identical dimensions as the insulating substrate 22 having an adhesive agent 32A on the bottom surface is provided to cover the serial bodies 25A–25C of movable contact points and fix them. In this way a switch is fabricated that contains individual switches disposed in a matrix arrangement.

Figure 11:
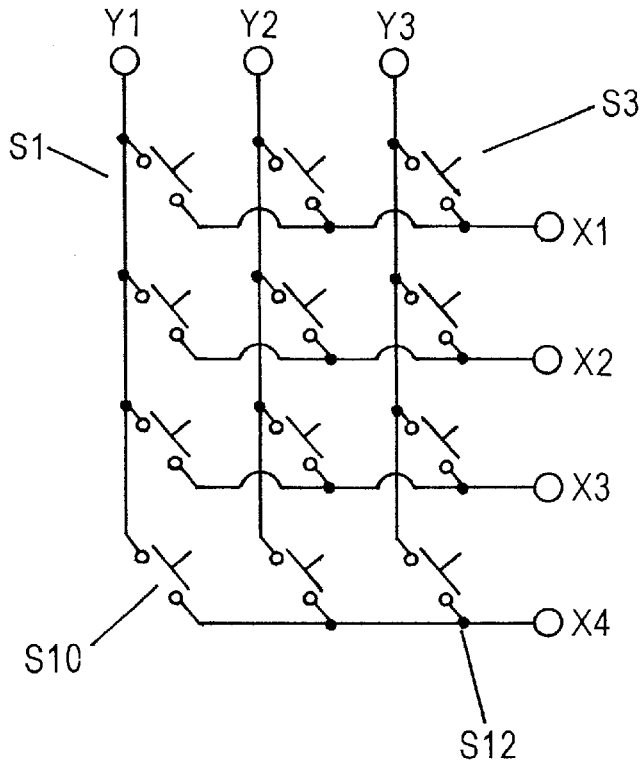
FIG. 11 is a connection diagram of the switches of FIG. 7.
Figure 12:
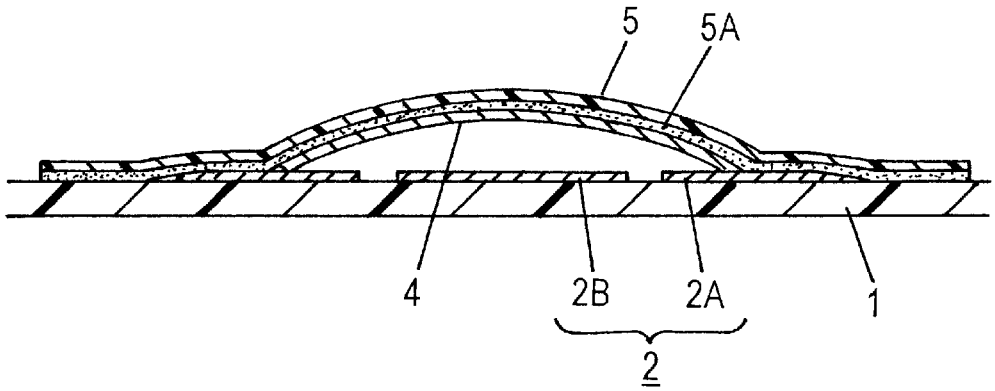
FIG. 12 (PRIOR ART)
FIG. 12 is a cross sectional view of a conventional switch in category one.
Figure 13:
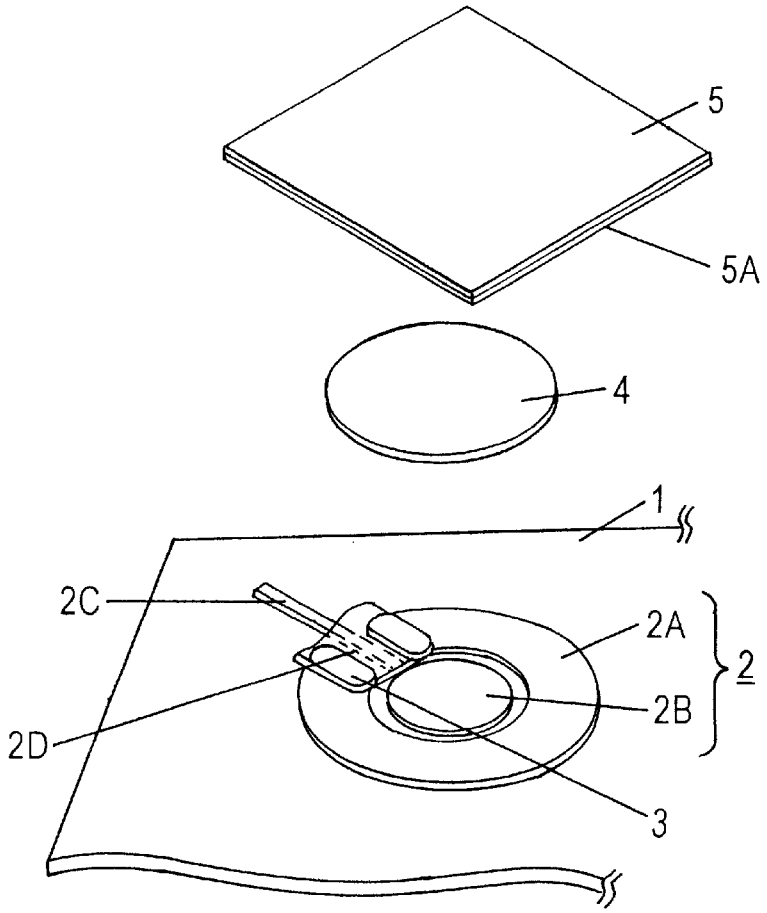
FIG. 13 (PRIOR ART)
FIG. 13 is an exploded perspective view of the switch of FIG. 12.
Figure 14:
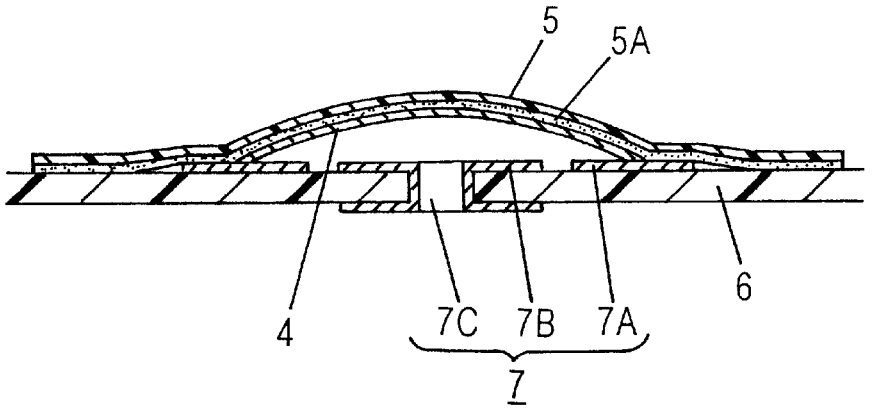
FIG. 14 (PRIOR ART)
FIG. 14 is a cross sectional view of a conventional switch in category two.
Figure 15:
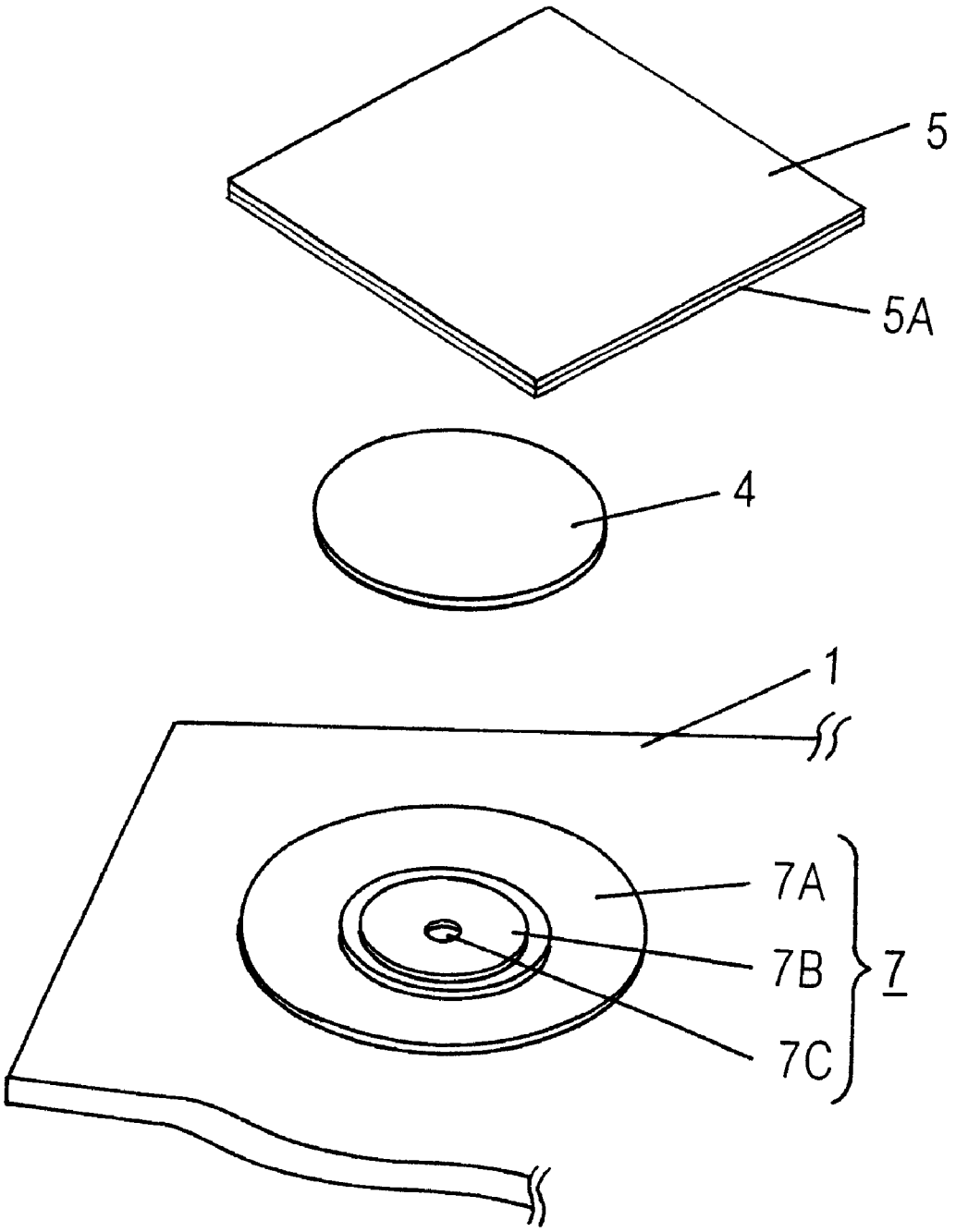
FIG. 15 (PRIOR ART)
FIG. 15 is an exploded perspective view of the switch of FIG. 14.

Wiring connection in a switch in embodiment 3 is as shown in FIG. 11. A matrix consists of four lateral contacts X1–X4 that have been formed by integrating the first fixed contact points T1–T12 pattern-formed on the insulating substrate 22 with the conduction sections 23A–23H and three longitudinal contacts Y1–Y3 that have been formed with the connecting bands 31A–31C each having four round dome sections 15A of respective serial bodies 25A–25C of movable contact points. The signals generated in accordance with operation of each of the individual switches S1–S12 locating at respective crossing points are delivered to the lead out section 22A in the form of a combination of four lead sections 24A–24D coming from the lateral contacts X1–X4 and three lead sections 27A–27C coming from the longitudinal contacts Y1–Y3.

Individual switches in the present embodiment 3 operate in the same principle as that of embodiment 1; so, description on which is omitted here.

As described in the above, a switch of the present embodiment 3 uses a side alley 17B, which was used when the movable contact points were produced out of an elastic thin metal sheet of belt shape by continuous processing, for the connecting band connecting the pluralities of movable contact points, as well as for the wiring member. As a result, the switch in embodiment 3 requires only a small number of constituent parts and components for the large number of switch contacts it has. As for assembling of the switch, it makes handling of the movable contact points easy, and the right positioning among the pluralities of movable contact points is well insured. Manufacturing cost for the switches is low. In this way, a new possibility has been offered for providing a compact and inexpensive switch block that contains a plurality of individual switches disposed in a matrix arrangement. The switch is suitable for use in an operation panel of electronic apparatus or the like device.

What is claimed is:

1. A switch comprising:

an insulating substrate:

a movable contact disposed above said insulating substrate, said movable contact comprising a round dome section, a flat section disposed at a place outside the circumference of the round dome section and a connection section connecting said round dome section with said flat section;

a first fixed contact having a diameter smaller than said round dome section, disposed on said insulating substrate at a place underneath said round dome section; and a second fixed contact disposed on said insulating substrate always keeping contact with said flat section.

2. The switch of claim 1, wherein said flat section is provided with a protrusion for making contact with said second fixed contact.

3. The switch of claim 1, wherein said movable contact is formed of a plurality of round dome sections connected respectively to said flat section, and said first fixed contact is formed of a plurality of contact sections corresponding to said pluralities of round dome sections.

4. The switch of claim 3, wherein said movable contact having said plurality of round dome sections, which are disposed in pluralities in parallel to each other, said pluralities of first fixed contact sections are connected in a direction perpendicular to the line of said pluralities of movable contacts, and said second fixed contact is provided in pluralities each always keeping contact with said flat section of said pluralities of movable contacts.

5. The switch of claim 1, further comprising an insulation layer provided around, at least in part of, said first fixed contact within a region underneath said round dome section.

6. The switch of claim 1, further comprising a flexible insulation film having an adhesive agent on the bottom surface that sticks on said insulating substrate covering said movable contact round dome section and said movable contact flat section.

7. The switch of claim 1, wherein said insulating substrate and said flat section of said movable contact are each provided with at least two perforations utilized for aligning said flat section of said movable contact on said insulating substrate.

8. The switch of claim 1, wherein said connection section of said movable contact has a width which is approximately at least five times greater than a thickness of said connection section.

9. The switch of claim 1, wherein said connection section of said movable contact has a width which is less than a width of said flat section of said movable contact.

10. The switch of claim 1, wherein said flat section of said movable contact has a plurality of end portions each of which extends beyond an outer portion of said second fixed contact.

* * * * *